United States Patent [19]

Mori et al.

[11] Patent Number: 4,788,455

[45] Date of Patent: Nov. 29, 1988

[54] CMOS REFERENCE VOLTAGE GENERATOR EMPLOYING SEPARATE REFERENCE CIRCUITS FOR EACH OUTPUT TRANSISTOR

[75] Inventors: Shigeru Mori; Hiroshi Miyamoto; Tadato Yamagata; Michihiro Yamada; Kazutami Arimoto, all of Itami, Japan

[73] Assignee: Mitsubishi Denki Kabushiki Kaisha, Tokyo, Japan

[21] Appl. No.: 891,897

[22] Filed: Aug. 1, 1986

[30] Foreign Application Priority Data

Aug. 9, 1985 [JP] Japan ..... 60-176331
Nov. 20, 1985 [JP] Japan ..... 60-260195

[51] Int. Cl.[4] ..... G05F 3/24

[52] U.S. Cl. ..... 307/297; 307/200 B; 323/314

[58] Field of Search ..... 307/200 B, 296 R, 297; 323/311–315, 317

[56] References Cited

U.S. PATENT DOCUMENTS 4,103,187 7/1978 Imamura ..... 307/200 B X
4,152,716 5/1979 Torii et al. ..... 323/311 X
4,224,539 9/1980 Musa et al. ..... 307/297 X
4,309,627 1/1982 Tabata ..... 307/297 X
4,327,321 4/1982 Suzuki et al. ..... 307/297 X
4,442,398 4/1984 Bertails et al. ..... 307/297
4,454,467 6/1984 Sakaguchi ..... 323/313
4,634,894 1/1987 Shu et al. ..... 307/297
4,663,584 5/1987 Okada et al. ..... 307/296 R X
4,692,689 9/1987 Takemae ..... 307/304 X

*Primary Examiner*—Stanley D. Miller
*Assistant Examiner*—D. R. Hudspeth
*Attorney, Agent, or Firm*—Birch, Stewart, Kolasch & Birch

[57] ABSTRACT

An internal power supply voltage generator for generating an internal power supply voltage for a semiconductor integrated device includes first and second reference voltage generators which produce first and second reference voltages having respective values a predetermined amount above and below an optimal value of the internal power supply voltage. The first and second reference voltage generators are constructed of a pair of serially connected NMOS and PMOS transistors, respectively, which transistors are connected between an external voltage supply and ground. The first and second reference voltages are applied to a CMOS output stage constructed of a NMOS and PMOS transistor serially connected between the external voltage supply and ground, the gates of the transistors being coupled to the first and second reference voltages, so as to provide said internal power supply voltage at a common node between the transistors. This voltage generator exhibits a lowered power dissipation and a lowered output impedance, as a result of providing a CMOS output stage.

9 Claims, 4 Drawing Sheets

CMOS REFERENCE VOLTAGE GENERATOR EMPLOYING SEPARATE REFERENCE CIRCUITS FOR EACH OUTPUT TRANSISTOR

FIELD OF THE INVENTION

The present invention relates to a semiconductor integrated circuit device internal power supply voltage generator for generating an internal power supply volgate on an integrated circuit chip from an external power supply.

BACKGROUND OF THE INVENTION

FIG. 7 shows a conventional internal power supply voltage generator which uses a resistive voltage divider. In FIG. 7, the reference numeral 8 designates a resistor having a resistance R8. One end of the resistor 8 is connected to the external power supply voltage Vcc, and the other end thereof is connected to a node N8. The reference numeral 9 designates a resistor having a resistance R9. One end thereof is connected to the node N8, and the other end thereof is connected to ground.

In this conventional circuit a voltage $V1=R9/(R8+R9).Vcc$ obtained by a voltage divider using the resistors 8 and 9, is generated at the output terminal V1 which is led out from the node N8, and this voltage is used as an internal power supply voltage of the semiconductor integrated circuit device. If it is supposed that R8 is equal to R9, a voltage ½ Vcc is generated at the terminal V1.

In this conventional internal power supply voltage generator of such a construction, a current usually flows from the external power supply Vcc to ground through the resistors 8 and 9, thereby resulting in an increased power dissipation. Furthermore, if the resistance R8 and R9 of the resistors 8 and 9 are made large in order to lower the power dissipation, the output impedance at the node N8 increases, thereby preventing the production of a large enough current from the node N8.

SUMMARY OF THE INVENTION

An object of the present invention is to provide an improved internal power supply voltage generator for a semiconductor integrated circuit device which exhibits a lowered power dissipation and a lowered output impedance.

Other objects and advantages of the present invention will become apparent from the detailed description given hereinafter; it should be understood, however, that the detailed description and specific embodiments are given by way of illustration only, since various changes and modifications within the spirit and scope of the invention will become apparent to those skilled in the art from this detailed description.

According to the present invention, there is provided an internal power supply voltage generator for a semiconductor inntegrated circuit device for generating an internal power supply voltage which is lower than the absolute value of an external power supply voltage from the external power supply on a semiconductor chip, comprising: a first reference voltage generator including a first and a second resistor element and a first and a second N channel MOS transistor serially connected between said external power supply and ground for outputting a first reference voltage which is level shifted by the threshold voltage of said N channel MOS transistor relative to an internal power supply voltage to be output; a second reference voltage generator including a third and a fourth resistor element and a third and a fourth P channel MOS transistor serially connected between said external power supply and ground for outputting a second reference voltage which is level shifted by the threshold voltage of said P channel MOS transistor relative to said internal power supply voltage to be output; and an internal power supply voltage outputting stage comprising an N channel and a P channel MOS transistor serially connected between said external power supply and the ground, which transistors are controlled by the output of said first and said second reference voltage generator, respectively.

DETAILED DESCRIPTION OF THE PREFERRED EMBODIMENTS

Figure 1:
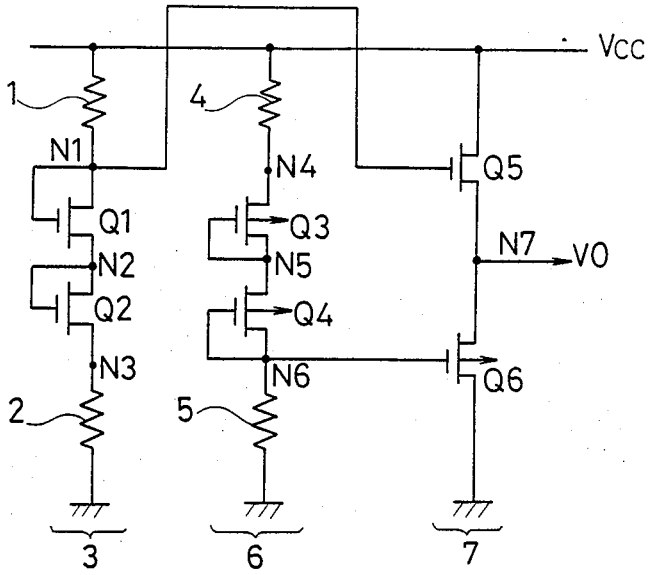
FIG. 1 is a circuit diagram showing an internal power supply voltage generator of a semiconductor integrated circuit device as a first embodiment of the present invention.

In order to explain the present invention in detail, reference will be particularly made to FIG. 1.

The present invention will be described with respect to the use of C-MOS circuits which include N channel MOS transistors and P channel MOS transistors because the present invention can be effectively applied thereto.

FIG. 1 shows a first embodiment of the present invention. In FIG. 1, the reference numeral 3 designates a first reference voltage generator which is constituted by connecting serially a resistor 1, N channel MOS transistors Q1 and Q2, and a resistor 2 between an external power supply Vcc and ground. The gate and drain of the N channel MOS transistor Q1 are connected to one end of the resistor 1 at a node N1, and the source thereof is connected to a node N2. The gate and drain of the N channel MOS transistor Q2 are connected to the node N2, and the source thereof is connected to the resistor 2 at a node N3.

The reference numeral 6 designates a second reference voltage generator which is constituted by connecting serially a resistor 4, P channel MOS transistors Q3 and Q4, and a resistor 5 between the power supply Vcc and ground. The drain of the P channel MOS transistor Q3 is connected to the resistor 4 at a node N4, and the gate and source thereof are connected to a node N5. The drain of the P channel MOS transistor Q4 is connected to the node N5, and the gate and source thereof are connected to the resistor 5 at a node N6.

The reference numeral 7 designates an internal power supply voltage outputting stage which is constituted by connecting serially an N channel MOS transistor Q5 and a P channel MOS transistor Q6 between power supply Vcc and the ground. The gate of the N channel MOS transistor Q5 is connected to the node N1, and the gate of the P channel MOS transistor Q6 is connected to the node N6. The output voltage V0 is output from the node N7 which connects transistors Q5 and Q6.

The device operates as follows.

When R1 is equal to R2 and transistors having the same characteristics are used for the N channel MOS transistors Q1 and Q2 in the first reference voltage generator 3, the voltage of the node N2 becomes $\frac{1}{2}$ Vcc. When the resistances R1 and R2 are made large so as to make only a slight current flow between Vcc and ground, a voltage which is higher than that of the node N2 by the threshold voltage $V_{THN}$ of the N channel MOS transistor Q1 is generated at the node N1. That is, a voltage ($\frac{1}{2}$ Vcc+$N_{THN}$) is generated at the node N1.

When R4 is made equal to R5 and transistors having the same characteristics are used for the P channel MOS transistors Q3 and Q4 in the second reference voltage generator 6, the voltage of the node N5 becomes $\frac{1}{2}$ Vcc. When the resistances R4 and R5 are made large so as to make only a slight current flow between Vcc and ground, a voltage which is lower than that of the node N5 by the threshold voltage of the P channel MOS transistor Q4 $|V_{THP}|$ is generated at the node N6. That is, a voltage ($\frac{1}{2}$ Vcc$-|V_{THP}|$) is generated at the node N6.

The above-describd voltage ($\frac{1}{2}$ Vcc+$V_{THN}$) is applied to the gate of the N channel MOS transistor Q5 of the internal power supply voltage outputting stage 7. At the node N7, that is, the source of the transistor Q5, a voltage lower than the gate voltage of the transistor Q5 by $V_{THN}$ is generated because the transistor Q5 is operated at the pentode operating region, that is, the following voltage V0 is obtained:

$$V0=\tfrac{1}{2}Vcc+VTHN-VTHN=\tfrac{1}{2}\ Vcc$$

On the other hand, a voltage ($\frac{1}{2}$ Vcc$-|V_{THP}|$) is applied to the gate of the P channel MOS transistor Q6 of the internal power supply voltage outputting stage 7. A voltage higher than the gate voltage of the transistor Q6 by $|V_{THP}|$ is generated at the node N7, that is, the drain of the transistor Q6 because the transistor Q6 is also operated at the pentode operating region. That is, the following voltage V0 is obtained:

$$V0=\tfrac{1}{2}Vcc-|VTHP|+|VTHP|=\tfrac{1}{2}\ Vcc$$

This voltage becomes equal to the voltage VO concerning the N channel MOS transistor 5, and thus there arises no conflict in the analysis of the circuit operation.

When V0 is equal to $\frac{1}{2}$ Vcc, both transistors Q5 and Q6 are in intermediate states between the conductive state and the non-conductive state, and a current flowing from Vcc to the ground in internal power supply voltage outputting stage 7 becomes 0. The currents flowing from Vcc to the ground in reference voltage generators 3 and 6 can be made quite small by increasing the values of R1, R2, R4, and R5, whereby an internal power supply voltage generator of low power dissipation is realized.

Now suppose that the voltage V0 deviates from $\frac{1}{2}$ Vcc. When the voltage V0 becomes higher than $\frac{1}{2}$ Vcc, the drain-source voltage of the P channel MOS transistor Q6 becomes high, and the transistor Q6 is turned on thereby to return the voltage V0 to $\frac{1}{2}$ Vcc. Meanwhile, the drain-source voltage of the N channel MOS transistor Q5 is lowered, and the transistor Q5 is kept off, and thus a current flowing from Vcc to ground through the transistors Q5 and Q6 becomes 0. On the other hand, when the voltage V0 becomes lower than $\frac{1}{2}$ Vcc, the drain-source voltage of the transistor Q5 increases, and the N channel MOS transistor Q5 is turned on thereby to return the voltage V0 to $\frac{1}{2}$ Vcc. Meanwhile, the drain-source voltage of the P channel MOS transistor Q6 is lowered, and the transistor Q6 is kept off, and a current flowing from Vcc to ground through the transistors Q5 and Q6 still remains 0. In this way, when the voltage V0 deviates from $\frac{1}{2}$ Vcc, either of the transistors Q5 and Q6 is immediately turned on thereby to return V0 to $\frac{1}{2}$ Vcc, whereby a sufficiently low output impedance is obtained.

Furthermore, in this embodiment a desired internal power supply voltage independent of the N channel and P channel MOS transistors constituting this circuit can be obtained.

Figure 2:
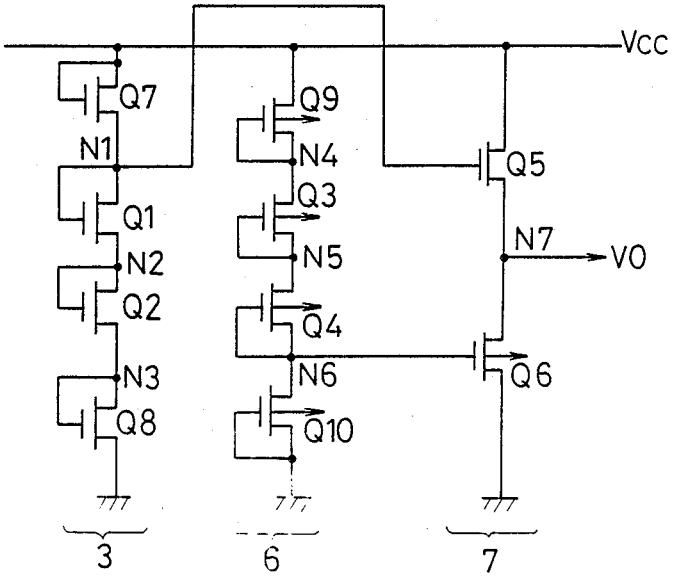
FIGS. 2 to 6 are circuit diagrams showing a second to sixth embodiment of the present invention, respectively.

FIG. 2 shows a second embodiment of the present invention. The reference characters Q1 to Q6 designate the same elements as those shown in FIG. 1. Four transistors Q7 to Q10 are used to function as resistors. The N channel MOS transistors Q7 and Q8 correspond to the resistors 1 and 2 of FIG. 1, and the drain and gate thereof are connected to each other. The P channel MOS transistors Q9 and Q10 correspond to the resistors 4 and 5 of FIG. 1, and the gate and source thereof are connected to each other.

The operation of the device of FIG. 2 is the same as that of FIG. 1. That is, when transistors having the same characteristics are used for the N channel MOS transistors Q7 and Q8, and transistors having the same characteristics are used for the P channel MOS transistors Q9 and Q10, the voltages at the nodes N2 and N5 become $\frac{1}{2}$ Vcc, respectively, similar to the operation of FIG. 1.

In above illustrated embodiments the output voltages of $\frac{1}{2}$ Vcc are obtained, but output voltages $\frac{1}{4}$ Vcc, $\frac{3}{4}$ Vcc, $\frac{1}{8}$ Vcc, $\frac{3}{8}$ Vcc, and $\frac{7}{8}$ Vcc can be obtained by combining the circuits of FIG. 1 or 2.

Furthermore, in the above illustrated embodiments R1 is made equal to R2, R4 is made equal to R5, and the transistors Q1 and Q2, and Q3 and Q4 are constituted by transistors having the same characteristics, respectively, but it is possible to control the output voltage by altering the ratio of the resistances.

Figure 3:
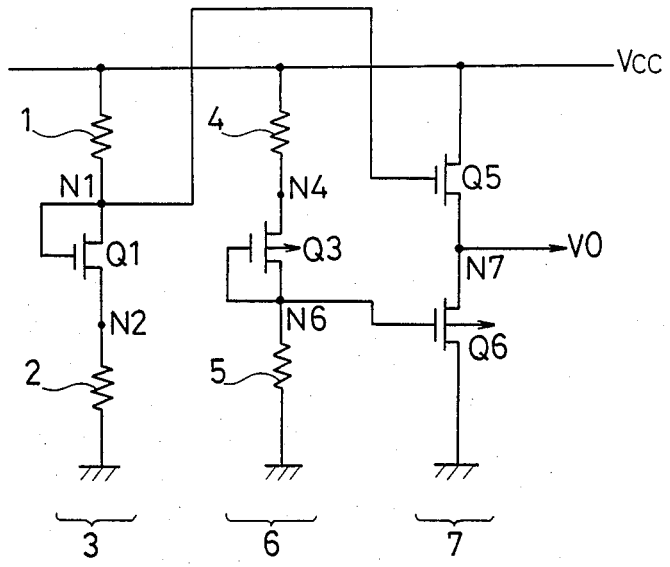

FIG. 3 shows a third embodiment of the present invention.

This third embodiment is obtained by replacing the two N channel MOS transistors Q1 and Q2 of FIG. 1 by a single N channel MOS transistor Q1 in the first reference voltage generator 3, and by replacing the two P channel MOS transistors Q3 and Q4 of FIG. 1 by a single P channel MOS transistor Q3 in the second reference voltage generator 6.

This device operates as follows.

In the first reference voltage generator 3, when the resistances R1 and R2 are made equal to each other and they are made large so as to make only a slight current flow from Vcc to ground, a voltage ($\frac{1}{2}$ Vcc+$\frac{1}{2}$ $V_{THN}$) is generated at the node N1, and a voltage ($\frac{1}{2}$ Vcc$-\frac{1}{2}$ $V_{THN}$) is generated at the node N2, where $V_{THN}$ is the threshold voltage of transistor Q1.

In the second reference voltage generator 6, when the resistance R4 and R5 are made equal to each other and they are made large so as to make only a slight current flow from Vcc to ground, a voltage ($\frac{1}{2}$ Vcc$-\frac{1}{2}$ $|V_{THP}|$) is generated at the node N6, and a voltage ($\frac{1}{2}$ Vcc+$\frac{1}{2}$ $|V_{THP}|$) is generated at the node N4, where $V_{THP}$ is the threshold voltage of transistor Q3.

Furthermore, the voltage ($\frac{1}{2}$ Vcc+$\frac{1}{2}$ $V_{THN}$) is applied to the gate of the N chanel MOS transistor Q5 of the internal power supply voltage outputting stage 7. When the voltage at the node N7, that is, at the source of the N channel MOS transistor 5 becomes lower than a voltage ($\frac{1}{2}$ Vcc$-\frac{1}{2}$ $V_{THN}$) which is lower than the gate voltage of the transistor Q5 by the threshold voltage $V_{THN}$, the N channel MOS transistor Q5 operating at the pentode operating region is turned on to thereby make the voltage at the node N7 ($\frac{1}{2}$ Vcc$-\frac{1}{2}$ $V_{THN}$).

On the other hand, the voltage ($\frac{1}{2}$ Vcc$-\frac{1}{2}|V_{THP}|$) is applied to the gate of the P channel MOS transistor Q6 of the internal power supply voltage outputting stage 7. When the voltage of the node N7, that is, the drain of the P channel MOS transistor Q6 becomes lower than a voltage ($\frac{1}{2}$ Vcc$+\frac{1}{2}|V_{THP}|$) which is lower than the gate voltage of the transistor Q6 by the threshold voltage $|V_{THP}|$, the transistor Q6 operating at the pentode operating region is turned on thereby to make the voltage of the node N7 ($\frac{1}{2}$ Vcc$+\frac{1}{2}|V_{THP}|$). That is, V0 becomes ($\frac{1}{2}$ Vcc$-\frac{1}{2}$ $V_{THN}$)$\leqq$V0$\leqq$($\frac{1}{2}$ Vcc$+\frac{1}{2}|V_{THP}|$).

In this way, when the output voltage V0 has a value between ($\frac{1}{2}$ Vcc$-\frac{1}{2}$ $V_{THN}$) and ($\frac{1}{2}$ Vcc$+\frac{1}{2}|V_{THP}|$), the transistors Q5 and Q6 are completely off, and a current flowing from Vcc to ground becomes 0 in the internal power supply voltage outputting stage 7. The current flowing from Vcc to ground in the reference voltage generators 3 and 6 can be made quite small by increasing the resistances R1, R2, R4, and R5, whereby an internal power supply voltage generator of a low power dissipation is realized.

Furthermore, when the output voltage V0 becomes lower than ($\frac{1}{2}$ Vcc$-\frac{1}{2}$ $V_{THN}$), the gate-source voltage of the transistor Q5 becomes high, and the N channel MOS transistor Q5 is turned on thereby to supply a current from Vcc to return the output voltage V0 to ($\frac{1}{2}$ Vcc$-\frac{1}{2}$ $V_{THN}$). Meanwhile, the drain-gate voltage of the P channel MOS transistor Q6 is lowered, and the transistor Q6 is kept off, and a current flowing from Vcc to the ground through the both transistors Q5 and Q6 remains 0.

On the other hand when the output voltage V0 becomes higher than ($\frac{1}{2}$ Vcc$+\frac{1}{2}|V_{THP}|$), the drain-gate voltage of the transistor Q6 becomes high, and the transistor Q6 is turned on thereby to conduct a discharge to the ground to return the output voltage V0 to ($\frac{1}{2}$ Vcc$+\frac{1}{2}|V_{THP}|$). Meanwhile, the drain-gate voltage of the N channel MOS transistor Q5 becomes low, and the transistor Q5 is kept off, and the current flowing from Vcc to the ground through the both transistor Q5 and Q6 still remains 0.

As described above, when the voltage of the output terminal V0 is deviated by moe than $\frac{1}{2}|V_{THP}|$ towards the high voltage side and by more than $\frac{1}{2}$ $V_{THN}$ towards the low voltage side from the voltage $\frac{1}{2}$ Vcc, either of the transistors Q5 or Q6 is immediately turned on to thereby return the output voltage V0 to between ($\frac{1}{2}$ Vcc$-\frac{1}{2}$ $V_{THN}$) and ($\frac{1}{2}$ Vcc$+\frac{1}{2}|V_{THP}|$), whereby a sufficiently low impedance is obtained.

In actual practice, the circuit of FIG. 1 has a disadvantage described below.

That is, although the circuit operates such that the voltage of the node N1 becomes ($\frac{1}{2}$ Vcc$+V_{THN}$), the voltage of the node N6 becomes ($\frac{1}{2}$ Vcc$-|V_{THP}|$), and the source voltage of the transistor Q5 controlled by the output of the first reference voltage generator 3 and the drain voltage of the transistor Q6 controlled by the output of the second reference voltage generator 6 become both $\frac{1}{2}$ Vcc, it is as a matter of fact impossible to make each of the resistances R1, R2, R3, and thus R4 an infinite value, and the voltages of the nodes N1 and N6 show a value a little larger than ($\frac{1}{2}$ Vcc$+V_{THN}$), and a value a little lower than ($\frac{1}{2}$ Vcc$-|V_{THP}|$), respectively, whereby the transistors Q5 and Q6 are made slightly on. As a result, a penetrating current flows from Vcc to ground through the transistors Q5 and Q6, and this prevents the enlarging of the transistors Q5 and Q6 to the extent necessary in order to obtain a low output impedance.

The third embodiment of the present invention has resolved this disadvantage. That is, even when the voltages of the node N1 and node N6 are deviated from ($\frac{1}{2}$ Vcc$+\frac{1}{2}$ $V_{THN}$) and ($\frac{1}{2}$ Vcc$-\frac{1}{2}|V_{THP}|$), respectively, only the upper and lower limits of the output voltage V0 are varied between a width of $\frac{1}{2}$ ($V_{THN}+|V_{THP}|$), and therefore either one of the transistors Q5 and Q6 is surely kept off, thereby disabling a penetrating current to flow. Thus, it is possible to enlarge the sizes of the transistors Q5 and Q6 without limitation, allowing the power dissipation and the output impedance to be lowered completely.

Figure 4:
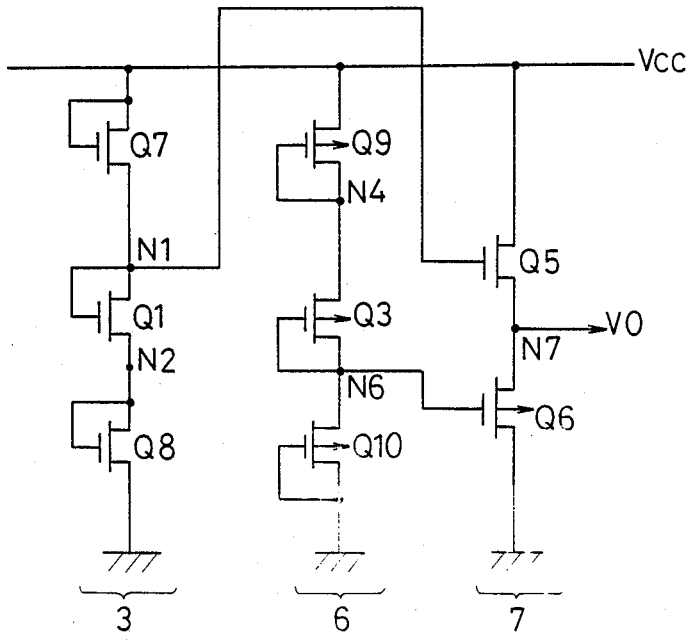

FIG. 4 shows a fourth embodiment of the present invention. The transistors Q1, Q3, Q5, and Q6 are the same ones as those shown in FIG. 3. Four MOS transistors Q7 to Q10 are used as resistors, the transistors Q7 and Q8 being N channel MOS transistors corresponding to the resistors 1 and 2 of FIG. 1, respectively, and the transistors Q9 and Q10 being P channel MOS transistors corresponding to the resistors 4 and 5 of FIG. 1, respectively.

The operation of the device of FIG. 4 is the same as that of FIG. 3. When the transistors Q7 and Q8, and Q9 and Q10 are constituted by transistors having the same characteristics, respectively, the output voltage V0 has a value between ($\frac{1}{2}$ Vcc$-\frac{1}{2}$ $V_{THN}$) and ($\frac{1}{2}$ Vcc$+\frac{1}{2}|V_{THP}|$), similar to in the circuit operation of FIG. 3.

Figure 5:
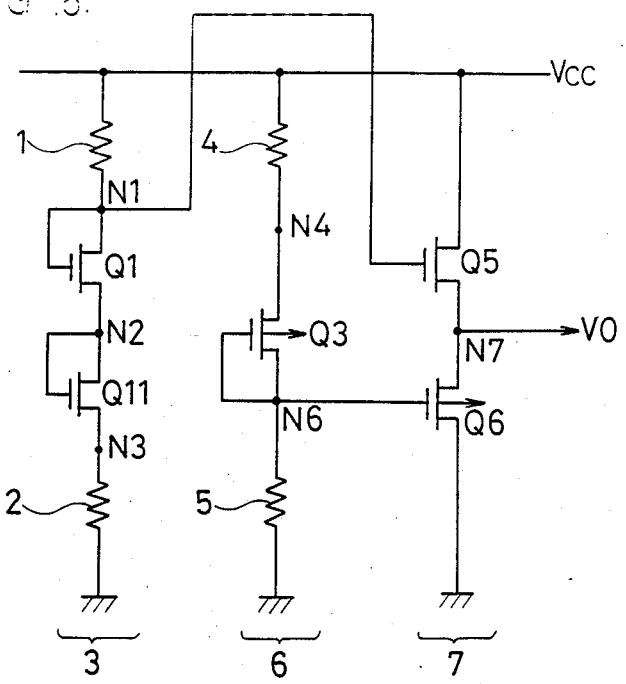

FIG. 5 shows a fifth embodiment of the present invention. This fifth embodiment is only different from the third embodiment of FIG. 3 in that an N channel MOS transistor Q11 having the same characteristics as that of the transistor Q1 is provided between the transistor Q1 and the resistor 2. The gate and drain of the transistor Q11 are connected to the node N2, and the source thereof is connected to the resistor 2 at node N3.

In such a construction the voltage of the node N2 becomes $\frac{1}{2}$ Vcc, and the voltage of the node N1 becomes ($\frac{1}{2}$ Vcc$+V_{THN}$). Thus, the lower limit of the voltage to be output V3 becomes $\frac{1}{2}$ Vcc. That is, when the output voltage V3 of the internal power supply voltage generator deviates from the range of $\frac{1}{2}$ Vcc$\leqq$V3$\leqq$($\frac{1}{2}$ Vcc$+\frac{1}{2}|V_{THP}|$), either of the transistors Q5 and Q6 is turned on to thereby return the output voltage V3 to between $\frac{1}{2}$ Vcc and ($\frac{1}{2}$ Vcc$+\frac{1}{2}|V_{THP}|$). In this circuit it is possible to control the output voltage at a higher preciseness than the third embodiment, and this circuit can be effectively used as a circuit for assuring that the output voltage does not become lower than $\frac{1}{2}$ Vcc.

Figure 6:
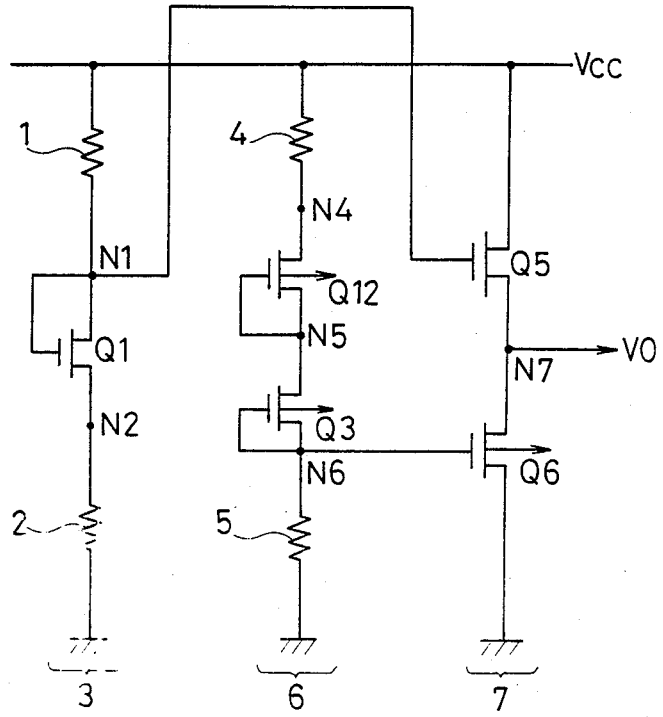
Figure 7:
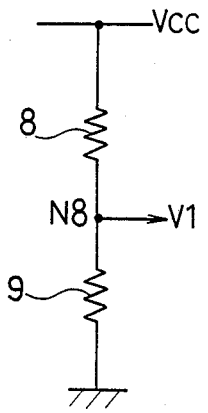
FIG. 7. (PRIOR ART)
FIG. 7 is a circuit diagram showing a prior art internal power supply voltage generator of a semiconductor integrated circuit device.

FIG. 6 shows a sixth embodiment of the present invention. This sixth embodiment is only different from the third embodiment of FIG. 3 in that a P channel transistor Q12 having the same characteristics as that of the transistor Q3 is provided between the resistor 4 and the transistor Q3. The drain of the transistor Q12 is connected to the node N4, and the source and gate thereof are connected to the drain of the transistor Q3 at the node N5 in the second reference voltage generator 6.

In such a construction the voltage of the node N5 becomes $\frac{1}{2}$ Vcc, and the voltage of the node N6 becomes ($\frac{1}{2}$ Vcc+$|V_{THP}|$). Thus, when the voltage to be output V4 is deviated from the range of ($\frac{1}{2}$ Vcc−$\frac{1}{2}$ $V_{THN}$)≦V4≦$\frac{1}{2}$ Vcc, either of the transistors Q5 and Q6 is turned on thereby to return the output voltage V4 to between ($\frac{1}{2}$ Vcc−$\frac{1}{2}$ $V_{THN}$) and $\frac{1}{2}$ Vcc. Also in this circuit it is possible to control the output voltage at a higher preciseness than that of the third embodiment, and this circuit can be effectively used as a circuit for assuring that the output voltage does not become higher than $\frac{1}{2}$ Vcc.

In the above descriptions the resistances R1 and R2, and R4 and R5 are made that R1=R2 and that R4=R5, respectively, and the transistors Q1 and Q11, and Q3 and Q12 are constituted by transistors having the same characteristics, respectively, but it is possible to control the output voltage by altering the ratio of the resistances.

Furthermore, the resistors 1 and 2 can be replaced by N channel transistors, and the resistors 4 and 5 can be replaced by P channel MOS transistors, with the same effects as described above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal power supply voltage generator for a semiconductor integrated circuit device for generating an internal power supply voltage which is lower than the absolute value of an external power supply voltage from an external power supply on a semiconductor chip, comprising:

a first reference voltage generator including a first and a second resistor element and a first and a second N channel MOS transistor serially connected between said external power supply and ground, said first and second N channel MOS transistors being serially connected between said first and second resistor elements, for outputting a first reference voltage which is level shifted by the threshold voltage of said first N channel MOS transistor relative to said internal power supply voltage to be generated;

a second reference voltage generator including a third and a fourth resistor element and a first and a second P channel MOS transistor serially connected between said external power supply and ground, said first and second P channel MOS transistors being serially connected between said third and fourth resistor elements, for outputting a second reference voltage which is level shifted by the threshold voltage of said second P channel MOS transistor relative to said internal power supply voltage to be generated; and an internal power supply voltage outputting stage comprising an N channel and a P channel MOS transistor serially connected between said external power supply and ground, which transistors are coupled to the outputs of said first and second reference voltage generators, respectively, to produce said internal power supply voltage.

2. The internal power supply voltage generator of claim 1, wherein said first, second, third, and fourth resistor elements comprise resistors.

3. The internal power supply voltage generator of claim 1, wherein said first and second resistor elements comprise N channel MOS transistors whose gate and drain are connected to each other, and said third and fourth resistor elements comprise P channel MOS transistors whose gate and source are connected to each other.

4. An internal power supply voltage generator for a semiconductor integrated circuit device for generating an internal power supply voltage which is lower than the absolute value of an external power supply voltage from an external power supply on a semiconductor chip comprising:

a first reference voltage generator including a first and a second resistor element and a first N channel MOS transistor serially connected between said external power supply and ground for outputting a first reference voltage of said N channel MOS transistor relative to either of the upper limit or the lower limit of said internal power supply voltage to be generated;

a second reference voltage geneator including a third and a fourth resistor element and a first P channel MOS transistor serially connected between said external power supply and ground for outputting a second reference voltage which is level shifted by the thresholdvoltage of said P channel MOS transistor relative to either of the lower limit or the upper limit of said internal power supply voltage to be generated, with respect to said first reference voltage; and an internal power supply voltage outputting stage comprising a second N channel and a second P channel MOS transistor serially connected between said external power supply and ground, which transistors are coupled to the outputs of said first and said second reference voltage generators, respectively, to produce said internal power supply voltage.

5. The internal power supply voltage generator of claim 4, wherein said first reference voltage is a voltage which is level shifted by half of the threshold voltage of said first N channel MOS transistor relative to a voltage obtained by dividing said external power supply voltage by said first and second resistor elements, and said second reference voltage is a voltage which is level shifted by half of the threshold voltage of said first P channel MOS transistor relative to a voltage obtained by dividing said external power supply voltage by said third and fourth resistor elements.

6. The internal power supply voltage generator of claim 4, wherein said first reference voltage is a voltage which is level shifted by the threshold voltage of said first N channel MOS transistor relative to a voltage obtained by dividing said external power supply voltage by said first and second resistor elements, and said second reference voltage is a voltage which is level shifted by half of the threshold voltage of said first P channel MOS transistor relative to a voltage obtained by dividing said external power supply voltage by said third and fourth resistor elements.

7. The internal power supply voltage generator of claim 4, wherein said first reference voltage is a voltage which is level shifted by half of the threshold voltage of said first N channel MOS transistor relative to a voltage obtained by dividing said external power supply voltage by said first and second resistor elements, and said second reference voltage is a voltage which is level shifted by the threshold voltage of said first P channel MOS transistor relative to a voltage obtained by dividing said external power supply voltage by said third and fourth resistor elements.

8. The internal power supply voltage generator of claim 4, wherein said first to fourth resistor elements comprise resistors.

9. The internal power supply voltage generator of claim 4, wherein said first and second resistor elements comprise N channel MOS transistors whose gate and drain are connected to each other, and said third and fourth resistor elements comprise P channel MOS transistors whose gate and source are connected to each other.

* * * * *